US009790903B2

(12) United States Patent
Takahashi et al.

(10) Patent No.: US 9,790,903 B2
(45) Date of Patent: Oct. 17, 2017

(54) INTAKE SOUND INTRODUCING APPARATUS

(71) Applicant: FUJI JUKOGYO KABUSHIKI KAISHA, Tokyo (JP)

(72) Inventors: Tetsuro Takahashi, Tokyo (JP); Kenichi Tsuchiya, Tokyo (JP); Takashi Seki, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 0 days.

(21) Appl. No.: 15/224,162

(22) Filed: Jul. 29, 2016

(65) Prior Publication Data

US 2016/0333832 A1 Nov. 17, 2016

Related U.S. Application Data

(62) Division of application No. 14/218,453, filed on Mar. 18, 2014, now Pat. No. 9,429,117.

(30) Foreign Application Priority Data

Mar. 25, 2013 (JP) ..... 2013-061942
Mar. 25, 2013 (JP) ..... 2013-061943
Mar. 25, 2013 (JP) ..... 2013-061944
Mar. 25, 2013 (JP) ..... 2013-061945

(51) Int. Cl.
*F02M 35/12* (2006.01)
*G10K 11/22* (2006.01)

(52) U.S. Cl.
CPC ..... *F02M 35/1294* (2013.01); *G10K 11/22* (2013.01)

(58) Field of Classification Search
CPC ..... F02M 35/1294
USPC ..... 181/229; 123/184.57
See application file for complete search history.

(56) References Cited

U.S. PATENT DOCUMENTS 6,848,410 B2 2/2005 Hoffmann et al.
7,448,353 B2 11/2008 Shinada et al.
7,621,370 B2 11/2009 Abe et al.
8,011,469 B2 9/2011 Olson
(Continued)

FOREIGN PATENT DOCUMENTS

JP 2007-170228 7/2007
JP 2008-267220 11/2008
(Continued)

OTHER PUBLICATIONS

Office Action issued Feb. 7, 2017 in Japanese Patent Application No. 2013-061944 (Japanese with English translation—5 pages).
(Continued)

*Primary Examiner* — Jeremy Luks
(74) *Attorney, Agent, or Firm* — Smith, Gambrell & Russell, LLP

(57) ABSTRACT

An intake sound introducing apparatus has, for example, a branch pipe, a sound creator, a communication pipe, and a resonator. The branch pipe branches from an intake pipe of the engine. The sound creator includes a vibrator that vibrates with the intake pulsation of the intake sound propagating within the branch pipe. The communication pipe provides communication between the inside of a casing of the sound creator and the inside of the cabin. The resonator is provided in the communication pipe.

6 Claims, 13 Drawing Sheets

(56) References Cited

U.S. PATENT DOCUMENTS

| | | | | |
|---|---|---|---|---|
| 8,127,888 | B1 | 3/2012 | Mah | |
| 2005/0121255 | A1 | 6/2005 | Hofmann et al. | |
| 2005/0133300 | A1* | 6/2005 | Hofmann | F02M 35/1294 181/250 |
| 2006/0065479 | A1 | 3/2006 | Okawa et al. | |
| 2007/0079784 | A1 | 4/2007 | Sasaki et al. | |
| 2011/0147116 | A1 | 6/2011 | Olson | |
| 2013/0121501 | A1* | 5/2013 | Jeong | F02M 35/125 381/71.5 |
| 2014/0284136 | A1 | 9/2014 | Takahashi et al. | |

FOREIGN PATENT DOCUMENTS

| | | |
|---|---|---|
| JP | 2008-291775 | 12/2008 |
| JP | 2009-030451 | 2/2009 |
| JP | 2012-107581 | 6/2012 |

OTHER PUBLICATIONS

Office Action issued Feb. 7, 2017 in Japanese Patent Application No. 2013-061945 (Japanese with English translation—5 pages).
Japanese Office Action for Application No. 2013-061944 dated Oct. 25, 2016 with English Translation (6 pages).
Japanese Office Action for Application No. 2013-061945 dated Oct. 25, 2016 with English Translation (5 pages).

* cited by examiner

INTAKE SOUND INTRODUCING APPARATUS

CROSS-REFERENCES TO RELATED APPLICATIONS

The present application claims priority from Japanese Patent Application Nos. 2013-061942, 2013-061943, 2013-061944, and 2013-061945, all filed on Mar. 25, 2013, the entire contents of which are hereby incorporated by reference.

BACKGROUND

1. Technical Field

The present invention relates to an intake sound introducing apparatus for introducing the intake sound of an engine mounted in a vehicle into a cabin.

2. Related Art

In recent years, there have been intake sound introducing apparatuses which introduce the intake sound of an engine mounted in a vehicle into a cabin for an enhanced sporty feel. For example, an intake sound introducing apparatus described in Japanese Unexamined Patent Application Publication (JP-A) No. 2009-030451 ("vehicular intake sound transmission device" in JP-A No 2009-030451) has a communication pipe, a vibrator, and a resonator pipe ("resonator" in JP-A No. 2009-030451). The communication pipe is branched out from the intake pipe of the engine, The vibrator is provided in the inside of the communication pipe, and vibrates with the intake pulsation of the intake sound propagating within the communication pipe. The resonator pipe is connected with the downstream-side end of the communication pipe, and formed so that its channel cross-sectional area changes monotonously from the upstream side toward the downstream side.

This intake sound introducing apparatus allows the intake sound to resonate at a desired frequency by means of the resonator pipe, thereby making desired sound louder and transmitting the sound into the cabin.

However, intake sound introducing apparatuses according to related art are not able to reduce unwanted high frequency components of the intake sound (for example, the valve noise of the engine, or intake sound transmitted at high speed). Consequently, unwanted sound is mixed in the intake sound transmitted into the cabin, which may make it impossible to transmit desired sound into the cabin.

SUMMARY OF THE INVENTION

The present invention has been made in view of the above-mentioned problem, and accordingly, it is an object of the present invention to provide an intake sound introducing apparatus that is capable of reducing unnecessary sound and transmitting desired sound into the cabin.

A first aspect of the present invention provides an intake sound introducing apparatus for introducing an intake sound of an engine mounted in a vehicle into a cabin, including: an upstream passage to transmit intake pulsation of the intake sound, the upstream passage including a branch passage, the branch passage branching from an intake system of the engine; a vibrator to vibrate with the intake pulsation of the intake sound in the upstream passage; a downstream passage to transmit vibration of the vibrator to the cabin, the downstream passage including a communication passage, the communication passage communicating with the cabin; and a resonator communicating with a passage extending from the upstream passage to the downstream passage.

The resonator may be provided in the downstream passage.

The communication passage may extend from a portion of the downstream passage which is located on a cabin side with respect to the vibrator, and the resonator may be provided in the communication passage.

The intake sound introducing apparatus may further include a sound creator including the vibrator and a casing, the casing surrounding the vibrator, the casing may have in its inside an inlet passage, the vibrator, and a space, the inlet passage communicating with the branch passage, the vibrator being disposed at a cabin side of the inlet passage, the space being defined between the inlet passage and the casing, and the resonator may be provided on an outside of the casing, the resonator communicating with a portion of the space in the casing which is located on a cabin side with respect to the vibrator.

The resonator may be disposed at a position corresponding to an antinode of a vibration produced inside the casing by the intake sound.

The resonator May be provided in a portion of the upstream passage which extends from the intake system to the vibrator.

In the upstream passage, the branch passage may branch from the intake system and extend toward the cabin to transmit the intake sound to the vibrator, and the resonator may be provided in the branch passage.

The intake sound introducing apparatus may further include a sound creator including the vibrator and a casing, the casing surrounding the vibrator, the casing may have in its inside an outlet passage, the vibrator, and a space, the outlet passage communicating with the communication passage, the vibrator being disposed at an intake system side of the outlet passage, the space being defined between the outlet passage and the casing, and the resonator may be provided on an outside of the casing, the resonator communicating with a portion of the space in the casing which is located on an intake system side with respect to the vibrator.

The resonator may be disposed at a position corresponding to an antinode of a vibration produced inside the casing by the intake sound.

A second aspect of the present invention provides an intake sound introducing apparatus for introducing an intake sound of an engine mounted in a vehicle into a cabin, including: a branch passage branching from an intake system of the engine; a sound creator communicating with the branch passage, the sound creator having a vibrator, the vibrator vibrating with intake pulsation of the intake sound propagating within the branch passage; and a communication passage communicating with the sound creator to transmit vibration of the vibrator into the cabin. At least one of the branch passage and the communication passage has a stepped portion.

The stepped portion may be a reduced stepped portion, the reduced stepped portion jutting outward with respect to a cabin-side portion of at least one of the branch passage and the communication passage in which the reduced stepped portion is provided, the reduced stepped portion having an inside cross-sectional area larger than an inside cross-sectional area of the cabin-side portion and extending toward the intake system, the reduced stepped portion communicating with at least one of the sound creator and the branch passage.

At least one of the branch passage and the communication passage may include the reduced stepped portion, and a downstream communication portion, the downstream communication portion being removably connected with an inner side of a cabin-side end of the reduced stepped portion, the downstream communication portion having a tubular shape with an outer shape smaller than the reduced stepped portion, and an intake system-side end of the downstream communication portion may be inserted into the cabin-side end of the reduced stepped portion to connect the downstream communication portion and the reduced stepped portion together.

The stepped portion may be an enlarged stepped portion, the enlarged stepped portion jutting outward with respect to an intake system-side portion of at least one of the branch passage and the communication passage in which the enlarged stepped portion is provided, the enlarged stepped portion having an inside cross-sectional area larger than an inside cross-sectional area of the intake system-side portion and extending toward the cabin, the enlarged stepped portion communicating with at least one of the sound creator and the cabin.

At least one of the branch passage and the communication passage may include the enlarged stepped portion, and an upstream communication portion, the upstream communication portion being removably connected with an inner side of an intake system-side end of the enlarged stepped portion, the upstream communication portion having a tubular shape with an outer shape smaller than the enlarged stepped portion, and a cabin-side end of the upstream communication portion may be inserted into the intake system-side end of the enlarged stepped portion to connect the upstream communication portion and the enlarged stepped portion together.

DETAILED DESCRIPTION

Hereinafter, preferred implementations of an intake sound introducing apparatus according to the present invention will be described with reference to the drawings.

First Implementation

Figure 1:
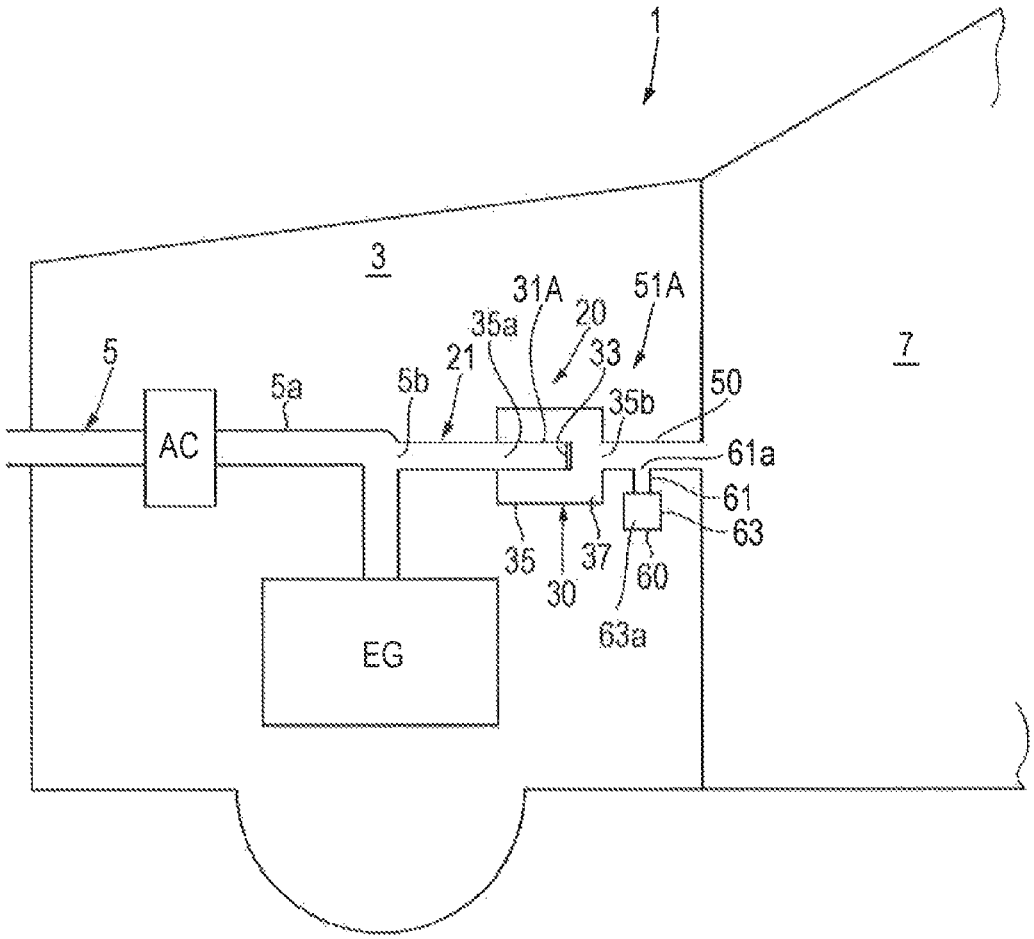
FIG. 1 is a schematic diagram of the lateral side of an intake sound introducing apparatus according to a first implementation of the present invention.

As illustrated in FIG. 1 (schematic diagram), an intake sound introducing apparatus 20 according to a first implementation is provided inside an engine compartment 3 of a vehicle 1. In the engine compartment 3, an intake pipe 5 for supplying combustion air to an engine EG is connected to the engine EG via an air cleaner AC. One end of the intake pipe 5 is open at and supported by a front end of the engine compartment 3. The other end of the intake pipe 5 is Connected with the engine EG. The intake pipe 5 is formed in a cylindrical shape from synthetic resin or the like. The intake sound introducing apparatus 20 for transmitting intake sound to the driver in a cabin 7 of the vehicle 1 is connected with a downstream side 5*a* of the intake pipe 5 located downstream of the air cleaner AC.

The intake sound introducing apparatus 20 has a branch pipe 21 that branches from the intake pipe 5, a sound creator 30 that communicates with the branch pipe 21, a communication pipe 50 that provides communication between the branch pipe 21 and the inside of the cabin 7 via the sound creator 30, and a resonator 60 that communicates with the communication pipe 50. The branch pipe 21 is disposed in the engine compartment 3 in such a way that one end of the branch pipe 21 is connected with an opening 5*b* provided at the downstream side 5*a* of the intake pipe 5 located downstream of the air cleaner AC, and the other end of the branch pipe 21 extends toward the cabin 7. The branch pipe 21 is formed in a cylindrical shape from synthetic resin or the like.

The sound creator 30 has an inlet pipe 31A connected with the cabin-side end of the branch pipe 21, a vibrator 33 provided at the cabin-side end of the inlet pipe 31A, and a casing 35 that surrounds the inlet pipe 31A. The vibrator 33 is a sheet-like diaphragm made of either one of synthetic resin and rubber. The vibrator 33 is provided so as to block the inlet pipe 31A inside the casing 35. The vibrator 33 vibrates with the intake pulsation of the intake sound that propagates within the branch pipe 21 and the inlet pipe 31A. The casing 35 is formed in a box shape. A front hole 35*a* is provided at one end side of the casing 35, and a rear hole 35*b* is provided at the other end side of the casing 35.

The intake pipe-side end of the inlet pipe 31A is open at and supported by the front hole 35*a*. The cabin-side end of the inlet pipe 31A is disposed opposite to the rear hole 35*b* with a predetermined distance inside. The front hole 35*a* is formed in substantially the same circular shape as the outer shape of the inlet pipe 31A, and the inlet pipe 31A is inserted in the front hole 35*a* so that there is no leakage of sound, from the front hole 35*a*. A space 37 surrounded by the casing 35 is defined around the inlet pipe 31A. The space 37 has a size that allows multiple frequencies included in the sound vibration generated with vibration of the vibrator 33 as a sound source to resonate owing to air column vibration. The rear hole 35*b* has substantially the same size as the vibrator 33 and is formed in a cylindrical shape. The rear hole 35*b* transmits the intake pulsation produced from the vibrator 33 to the communication pipe 50. The space 37 and the communication pipe 50 which are used for transmitting vibrations of the vibrator 33 to the cabin 7 will be hereinafter referred to as downstream passage 51A.

In the downstream passage 51A, the resonator 60 is connected with a portion of the communication pipe 50 which is located on the cabin side with respect to the vibrator 33. The resonator 60 has a neck 61 having a tubular shape, and a body 63 having a box shape. One end side of the neck 61 is connected with the communication pipe 50. The body 63 is connected with the other end side of the neck 61, and has a resonator space 63*a* defined inside the body 63. When a specific frequency of intake sound hits the resonator 60, movement of the intake sound becomes intense at the portion of a hole 61*a* inside the neck 61, causing frictional loss, which creates a sound absorption effect centered on that frequency. In the first implementation, the resonator 60 is configured to create a sound absorption effect for unwanted high frequency components of sound (for example, the valve noise of the engine EG or intake sound transmitted at high speed).

In the intake sound introducing apparatus 20 configured in this way, when outside air is taken in through the intake pipe 5 as the engine EG is driven, an intake pulsation at a frequency corresponding to the rotational speed of the engine EG is generated inside the intake pipe 5. This intake pulsation is transmitted to the vibrator 33 through the branch pipe 21 from the intake pipe 5. Consequently, the vibrator 33 vibrates at a frequency corresponding to the rotational speed of the engine EG. Therefore, a sound vibration is created inside the sound creator 30, with the vibration of the vibrator 33 as a sound source. Then, multiple frequencies included in the sound vibration resonate owing to vibration of air column in the casing 35 and are transmitted to the communication pipe 50.

At this time, high frequency components of the sound vibration transmitted to the communication pipe 50 are absorbed by the resonator 60. Consequently, unwanted high frequency components of the intake sound, for example, the valve noise of the engine EG or intake sound transmitted at high speed, may be reduced. Consequently, the intake sound transmitted from the communication pipe 50 into the cabin 7 does not include unwanted high frequency components. Therefore, a desired intake sound may be transmitted into the cabin 7. Moreover, although the resonator 60 absorbs unwanted high frequency components of sound, the resonator 60 does not affect desired frequency ranges. Therefore, there is no decrease in the magnitude of desired frequencies of sound. In addition, the resonator 60 is configured to allow the intake pulsation of the intake sound transmitted to the communication pipe 50 to be amplified by the resonance effect. Therefore, the capacity of the sound creator 30 may be reduced to achieve miniaturization.

Figure 2:
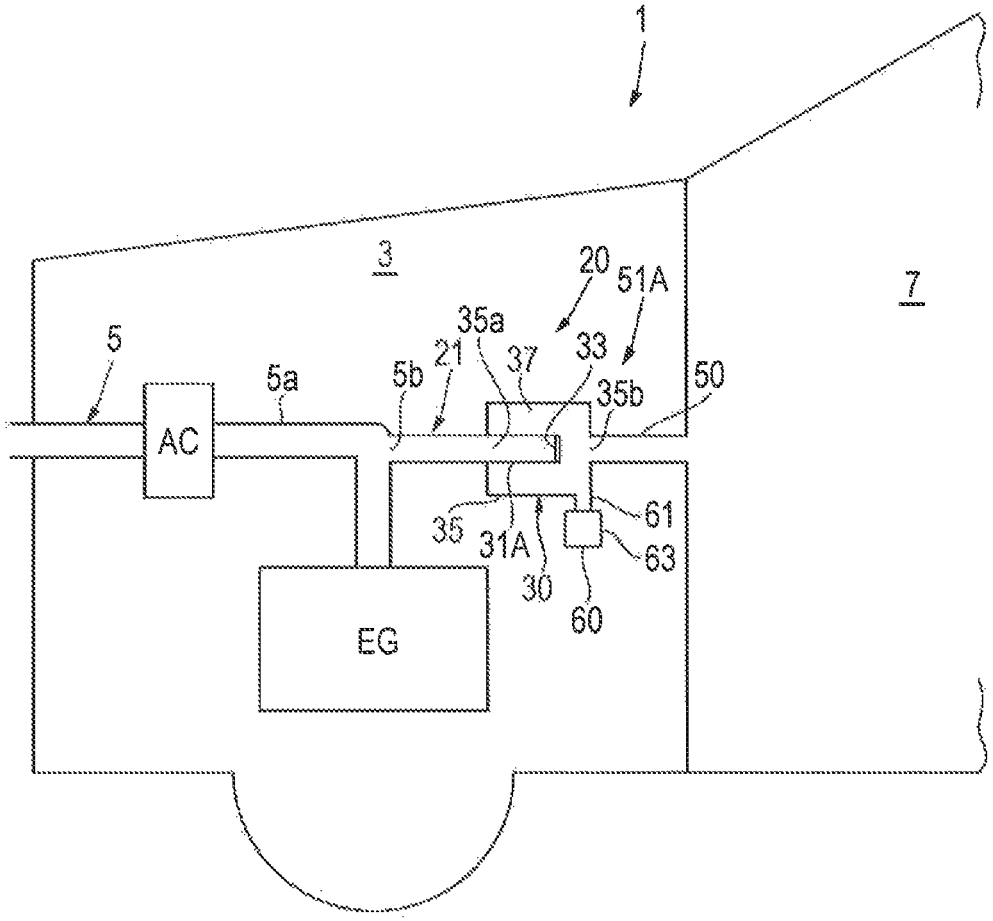
FIG. 2 is a schematic diagram of the lateral side of a modification of the intake sound introducing apparatus illustrated in FIG. 1.

While the first implementation is directed to the case in which the resonator 60 is provided in the portion of the communication pipe 50 connected on the cabin side with respect to the sound creator 30, the resonator 60 may be provided on the outside of the casing 35 of the sound creator 30 as illustrated in FIG. 2. The casing 35 is formed in a shape that allows high frequency components of sound Sh to resonate within the space 37 of the casing 35. The resonator 60 is provided on the outside of the portion of the casing 35 located on the cabin side with respect to the vibrator 33, and communicates with the space 37 in the inside of the casing 35.

Figure 3:
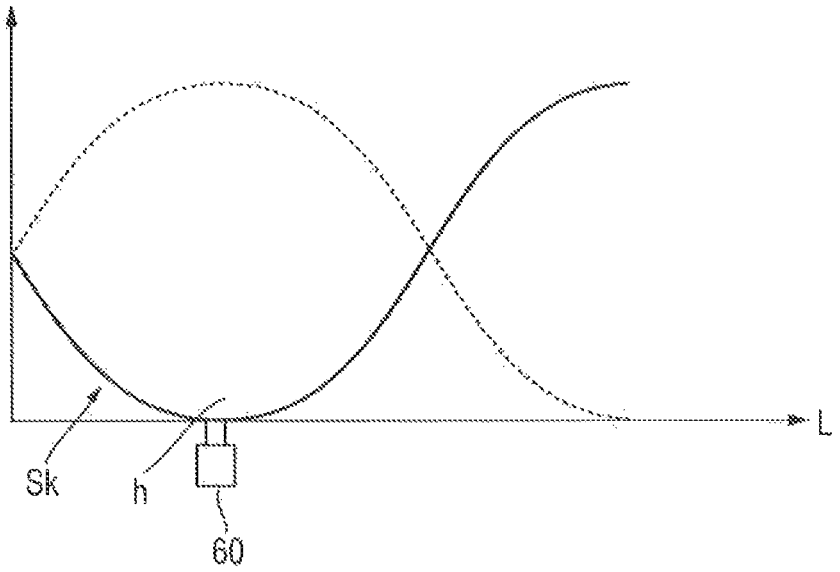
FIG. 3 is an explanatory diagram for explaining the mounting position of a resonator according to the first implementation.

The mounting position of the resonator 60 with respect to the casing 35 according to the first implementation will be described with reference to FIG. 3. In FIG. 3, for example, the horizontal axis L indicates the length of the casing 35 in the transmission direction of sound. As illustrated in FIG. 3, the resonator 60 is disposed at a position corresponding to the antinode h of vibration of intake sound Sk at resonance. Therefore, the intake sound Sk at resonance may be effectively absorbed by the resonator 60.

For this reason, unwanted high frequency components of the intake sound, for example, the valve noise of the engine EG or intake sound transmitted at high speed may be reduced, thereby allowing a desired intake sound to be transmitted into the cabin 7 via the communication pipe 50.

While the cross-sectional shapes of the branch pipe 21 and communication pipe 50 are circular in the first implementation mentioned above, this should not be construed restrictively. The cross-sectional shapes of these components may be any one of triangular, rectangular, and polygonal shapes.

Second Implementation

Figure 4:
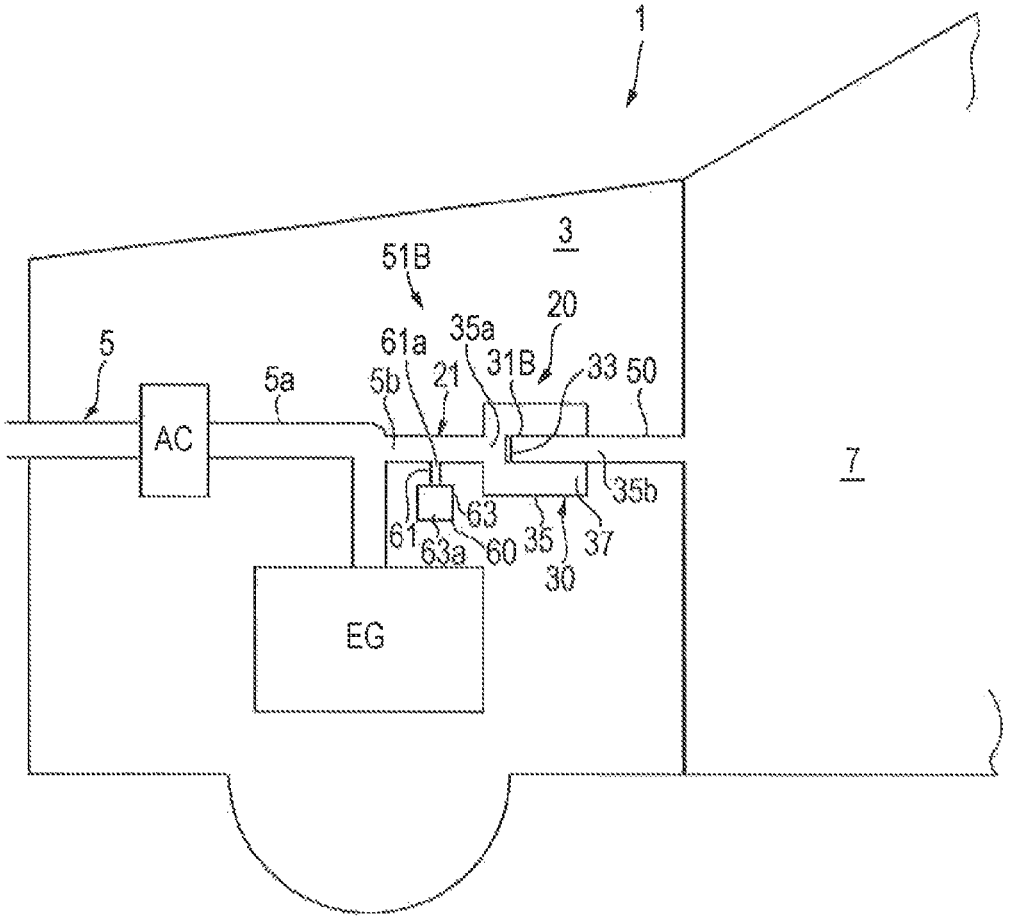
FIG. 4 is a schematic diagram of the lateral side of an intake sound introducing apparatus according to a second implementation of the present invention.

As illustrated in FIG. 4 (schematic diagram), an intake sound introducing apparatus 20 according to a second implementation is provided inside an engine compartment 3 of a vehicle 1. In the engine compartment 3, an intake pipe 5 for supplying combustion air to an engine EG is connected to the engine EG via an air cleaner AC. One end of the intake pipe 5 is open at and supported by a front end of the engine compartment 3. The other end of the intake pipe 5 is connected with the engine EG. The intake pipe 5 is formed in a cylindrical shape from synthetic resin or the like. The intake sound introducing apparatus 20 for transmitting intake sound to the driver in a cabin 7 of the vehicle 1 is connected with a downstream side 5*a* of the intake pipe 5 located downstream of the air cleaner AC.

The intake sound introducing apparatus 20 has a branch pipe 21 that branches from the intake pipe 5, a sound creator 30 that communicates with the branch pipe 21, a communication pipe 50 that provides communication between the branch pipe 21 and the inside of the cabin 7 via the sound creator 30, and a resonator 60 that communicates with the branch pipe 21. The branch pipe 21 is disposed in the engine compartment 3 in such a way that one end of the branch pipe 21 is connected with an opening 5*b* provided at the downstream side 5*a* of the intake pipe 5 located downstream of the air cleaner AC, and the other end of the branch pipe 21 extends toward the cabin 7. The branch pipe 21 is formed in a cylindrical shape from synthetic resin or the like.

The sound creator 30 has an outlet pipe 31B connected with the intake system-side end of the branch pipe 21, a vibrator 33 provided at the intake system-side end of the outlet pipe 31B, and a casing 35 that surrounds the outlet pipe 31B. The vibrator 33 is a sheet-like diaphragm made of either one of synthetic resin and rubber, which vibrates with the intake pulsation of the intake sound that propagates through the branch pipe 21. The casing 35 is formed in a box shape. A front hole 35*a* is provided at one end side of the casing 35, and a rear hole 35*b* is provided at the other end side of the casing 35.

The cabin-side end of the branch pipe 21 is open at and connected with the front hole 35*a*. The cabin-side end of the outlet pipe 31B is open at and supported by the rear hole 35*b*. The intake system-side end of the outlet pipe 31B is disposed opposite to the front hole 35*a* with a predetermined distance inside. The rear hole 35*b* is formed in substantially the same circular shape as the outer shape of the outlet pipe 31B, and the outlet pipe 31B is inserted in the rear hole 35*b* so that there is no leakage of sound from the rear hole 35*b*. A space 37 surrounded by the casing 35 is defined around the outlet pipe 31B. The space 37 has a size that allows multiple frequencies included in the sound vibration generated with vibration of the vibrator 33 as a sound source to resonate owing to air column vibration. The rear hole 35*b* has substantially the same size as the vibrator 33 and is formed in a cylindrical shape. The rear hole 35*b* transmits the intake pulsation produced from the vibrator 33 to the communication pipe 50. The branch pipe 21 and the space 37 that constitute the passage from the intake system to the vibrator 33 will be hereinafter referred to collectively as upstream passage 51B.

The resonator 60 is connected with a portion of the branch pipe 21 of the upstream passage 51B which is located on the intake system side with respect to the vibrator 33. The resonator 60 has a neck 61 having a tubular shape, and a body 63 having a box shape. One end side of the neck 61 is connected with the branch pipe 21. The body 63 is connected with the other end side of the neck 61, and has a resonator space 63*a* defined inside the body 63. When a specific frequency of intake sound hits the resonator 60, movement of the intake sound becomes intense at the portion of a hole 61*a* in the neck 61, causing frictional loss, which creates a sound absorption effect centered on that frequency. In the second implementation, the resonator 60 is configured to create a sound absorption effect for unwanted high frequency components of sound (for example, the valve noise of the engine EG or intake sound transmitted at high speed).

In the intake sound introducing apparatus 20 configured in this way, when outside air is taken in through the intake pipe 5 as the engine EG is driven, an intake pulsation at a frequency corresponding to the rotational speed of the engine EG is generated inside the intake pipe 5. The intake pulsation is transmitted to the vibrator 33 through the branch pipe 21 and the space 37 from the intake pipe 5. Consequently, the vibrator 33 vibrates at a frequency corresponding to the rotational speed of the engine EG. Therefore, a sound vibration is created inside the sound creator 30, with the vibration of the vibrator 33 as a sound source. Then, multiple frequencies included in the sound vibration resonate owing to vibration of air column in the casing 35 and are transmitted to the communication pipe 50.

At this time, high frequency components of the sound vibration transmitted to the communication pipe 50 are absorbed by the resonator 60. Consequently, unwanted high frequency components of the intake sound, for example, the valve noise of the engine EG or intake sound transmitted at high speed, may be eliminated. Consequently, the sound generated from the vibrator 33 of the sound creator 30 does not include unwanted high frequency components. Therefore, a desired intake sound may be transmitted into the cabin 7 via the communication pipe 50.

Since high frequency components of the sound vibration transmitted to the intake pipe 5 are absorbed by the resonator 60, the intake sound generated from the vibrator 33 of the sound creator 30 does not include high frequency components. Consequently, the required strength of the casing 35 of the sound creator 30 may be minimized, which allows the strength of the casing 35 to be easily designed.

Figure 5:
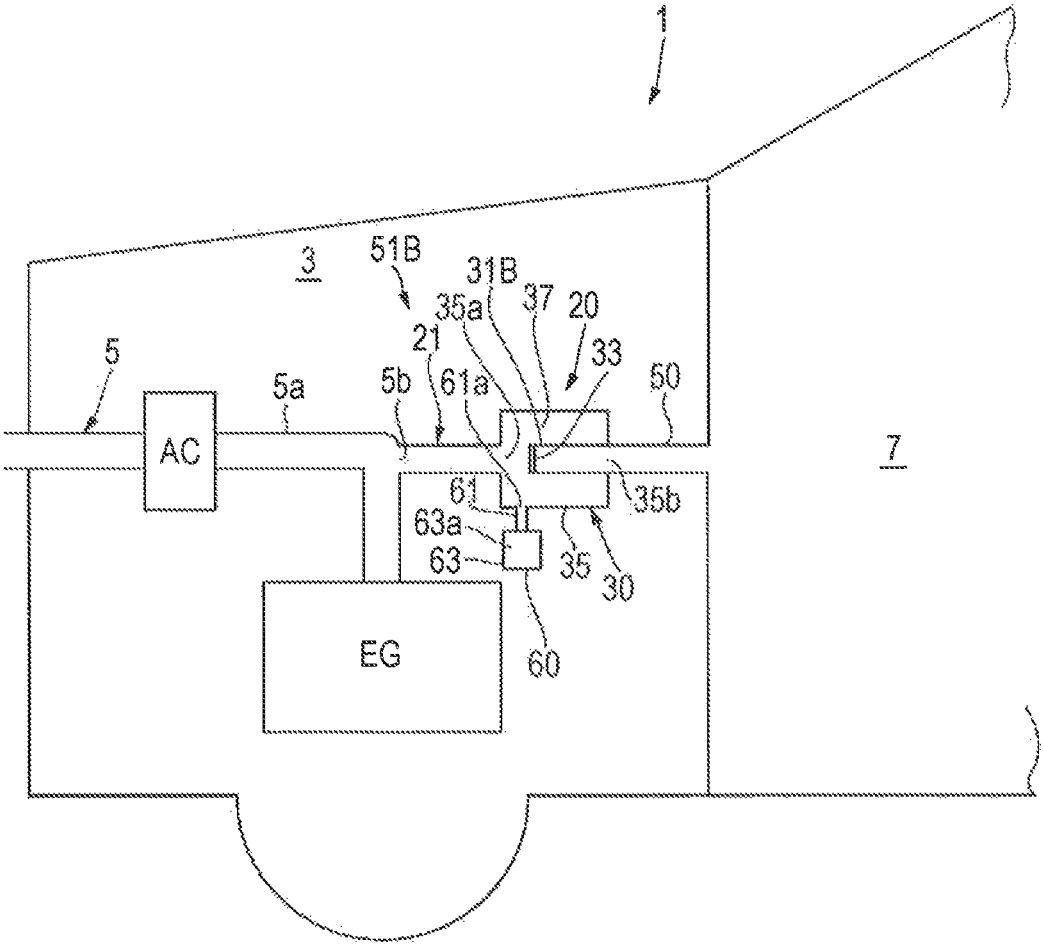
FIG. 5 is a schematic diagram of the lateral side of a modification of the intake sound introducing apparatus illustrated in FIG. 4.

While the second implementation is directed to the case in which the resonator GO is provided in the portion of the branch pipe 21 located on the intake system side with respect to the vibrator 33, the resonator 60 may be provided on the outside of the casing 35 of the sound creator 30 as illustrated in FIG. 5. The casing 35 is formed in a shape that allows high frequency components of sound to resonate within the space 37. The resonator 60 communicates with a portion of the space 37 inside the casing 35 which is located on the intake system side with respect to the vibrator 33.

The mounting position of the resonator 60 according to the second implementation will be described with reference to FIG. 3. In FIG. 3, for example, the horizontal axis L indicates the length of the casing 35 in the transmission direction of sound. As illustrated in FIG. 3, the resonator 60 is disposed at a position corresponding to the antinode h of vibration of intake sound Sk at resonance. Therefore, the intake sound Sk at resonance may be effectively absorbed by the resonator 60.

For this reason, unwanted high frequency components of the intake sound, for example, the valve noise of the engine EG or intake sound transmitted at high speed may be reduced, thereby allowing a desired intake sound to be transmitted into the cabin 7 via the communication pipe 50.

While the cross-sectional shapes of the branch pipe 21 and communication pipe 50 are circular in the second implementation mentioned above, this should not be construed restrictively. The cross-sectional shapes of these components may be any one of triangular, rectangular, and polygonal shapes.

Third Implementation

Figure 6:
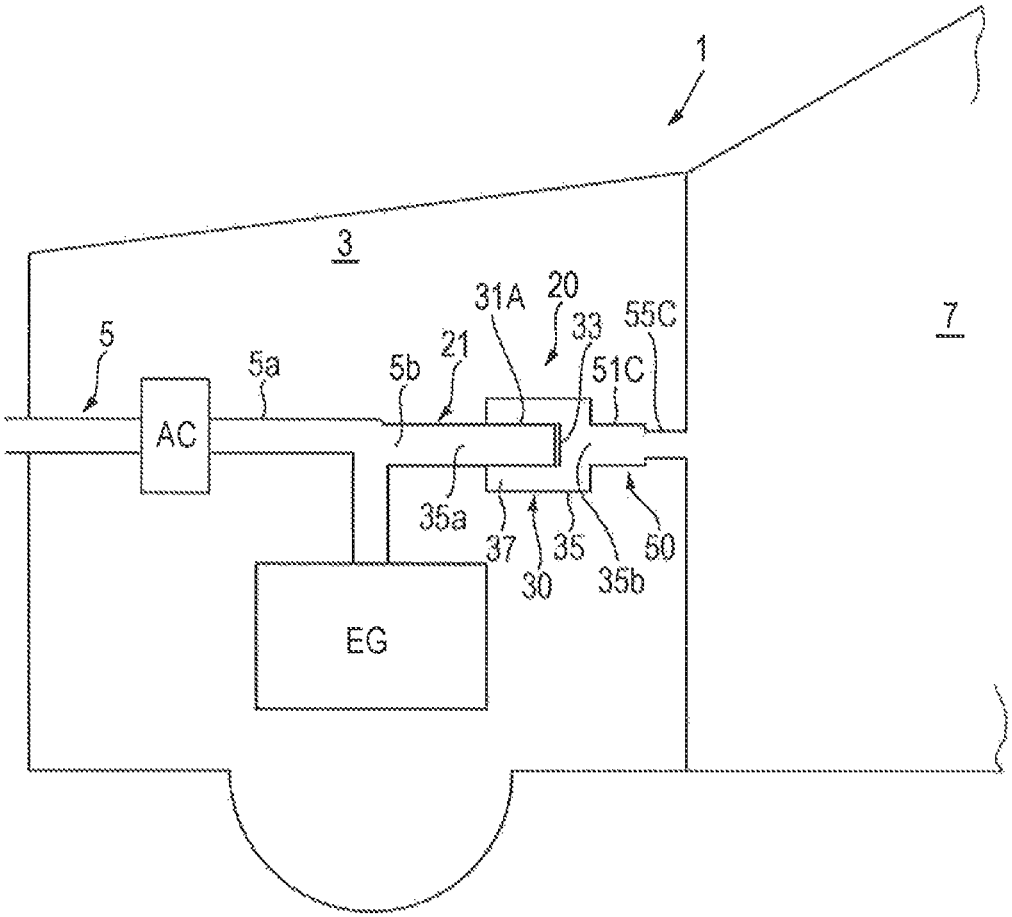
FIG. 6 is a schematic diagram of the lateral side of an intake sound introducing apparatus according to a third implementation of the present invention.

As illustrated in FIG. 6 (schematic diagram), an intake sound introducing apparatus 20 according to a third implementation is provided inside an engine compartment 3 of a vehicle 1. In the engine compartment 3, an intake pipe 5 for supplying combustion air to an engine EG is connected to the engine EG via an air cleaner AC. One end of the intake pipe 5 is open at and supported by a front end of the engine compartment 3. The other end of the intake pipe 5 is connected with the engine EG. The intake pipe 5 is formed in a cylindrical shape from synthetic resin or the like. The intake sound introducing apparatus 20 for introducing intake sound to the driver in a cabin 7 of the vehicle 1 is connected with a downstream side 5*a* of the intake pipe 5 located downstream of the air cleaner AC.

The intake sound introducing apparatus 20 has a branch pipe 21 that branches from the intake pipe 5, a sound creator 30 that communicates with the branch pipe 21, and a communication pipe 50 that provides communication between the sound creator 30 and the inside of the cabin 7. The branch pipe 21 is disposed in the engine compartment 3 in such a way that one end of the branch pipe 21 is connected with an opening 5*b* provided at the downstream side 5*a* of the intake pipe 5 located downstream of the air cleaner AC, and the other end of the branch pipe 21 extends toward the cabin 7. The branch pipe 21 is formed in a cylindrical shape from synthetic resin or the like.

The sound creator 30 has an inlet pipe 31A connected with the cabin-side end of the branch pipe 21, a vibrator 33 provided at the cabin-side end of the inlet pipe 31A, and a casing 35 that surrounds the inlet pipe 31A. The vibrator 33 is a sheet-like diaphragm made of either one of synthetic resin and rubber, which vibrates with the intake pulsation of the intake sound propagating within the branch pipe 21 and the inlet pipe 31A. The casing 35 is formed in a box shape. A front hole 35*a* is provided at one end side of the casing 35, and a rear hole 35*b* is provided at the other end side of the casing 35.

The intake pipe-side end of the inlet pipe 31A is open at and supported by the front hole 35*a*. The cabin-side end of the inlet pipe 31A is disposed opposite to the rear hole 35*b* with a predetermined distance inside. The front hole 35*a* is formed in substantially the same circular shape as the outer shape of the inlet pipe 31A, and the inlet pipe 31A is inserted in the front hole 35*a* so that there is no leakage of sound from the front hole 35*a*. A space 37 surrounded by the casing 35 is defined around the inlet pipe 31A. The space 37 has a size that allows multiple frequencies included in the sound vibration generated with vibration of the vibrator 33 as a sound source to resonate owing to air column vibration. The rear hole 35*b* has substantially the same size as the vibrator 33 and is formed in a cylindrical shape. The rear hole 35*b* transmits the intake pulsation produced from the vibrator 33 to the communication pipe 50.

Figure 7A:
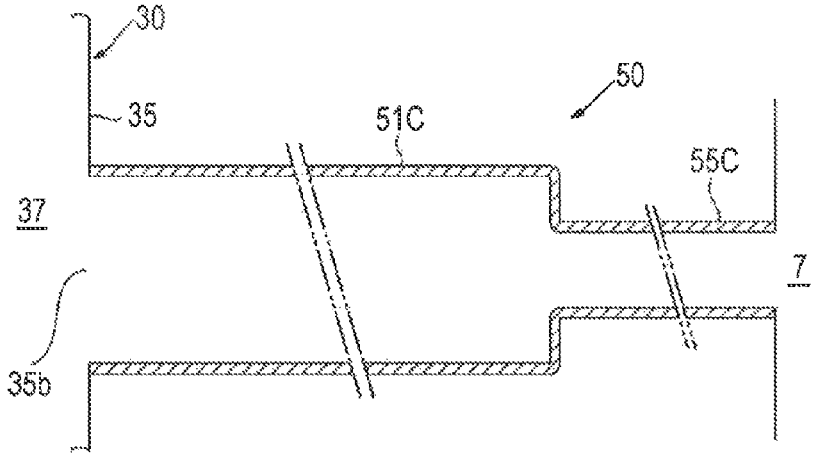
FIG. 7A is a cross-sectional view of a communication pipe according to the third implementation.

As illustrated in FIG. 6 and FIG. 7A (cross-sectional view), the communication pipe 50 has a reduced stepped portion 51C having a tubular shape, and a downstream communication portion 55C having a tubular shape. The reduced stepped portion 51C functions as a large diameter communication pipe connected with the rear hole 35*b* of the casing 35. The downstream communication portion 55C is connected with the cabin-side end of the reduced stepped portion 51C. The reduced stepped portion 51C has substantially the same inside diameter as the inside diameter of the rear hole 35*b*, and communicates with the sound creator 30. The reduced stepped portion 51C juts outward with respect to the downstream communication portion 55C to define a stepped shape whose inside diameter changes in a non-continuous fashion. The reduced stepped portion 51C extends toward the cabin to communicate with the downstream communication portion 55C. The reduced stepped portion 51C communicates with the downstream communication portion 55C, while having an inside cross-sectional area larger than the inside cross-sectional area of the downstream communication portion 55C.

The downstream communication portion 55C communicates with the cabin 7 while having an inside cross-sectional area smaller than the inside cross-sectional area of the reduced stepped portion 51C. The downstream communication portion 55C is disposed substantially coaxially with the reduced stepped portion 51C. The intake pipe-side end of the downstream communication portion 55C is integrally connected with the cabin-side end of the reduced stepped portion 51C.

In the intake sound introducing apparatus 20 configured in this way, as illustrated in FIG. 6, when outside air is taken in through the intake pipe 5 as the engine EG is driven, an intake pulsation at a frequency corresponding to the rotational speed of the engine EG is generated inside the intake pipe 5. The intake pulsation is transmitted to the vibrator 33 of the sound creator 30 through the branch pipe 21 from the intake pipe 5. Consequently, the vibrator 33 vibrates at a frequency corresponding to the rotational speed of the engine EG. Therefore, a sound vibration is created inside the sound creator 30, with the vibration of the vibrator 33 as a sound source. Then, multiple frequencies included in the sound vibration resonate owing to vibration of air column in the casing 35 and are transmitted to the communication pipe 50.

Then, unwanted high frequency components of the intake sound transmitted to the communication pipe 50, for example, the valve noise of the engine EG and intake sound transmitted at high speed, are reduced in magnitude when transmitted from the reduced stepped portion 51C of the communication pipe 50 to the downstream communication portion 55C. Consequently, the magnitude of unwanted high frequency components of the intake sound transmitted into the cabin 7 may be reduced, and a desired intake sound may be transmitted into the cabin 7.

The reasons why unwanted high frequency components of sound may be reduced by means of the reduced stepped portion 51C and the downstream communication portion 55C are considered to be as follows.

Figure 8A:
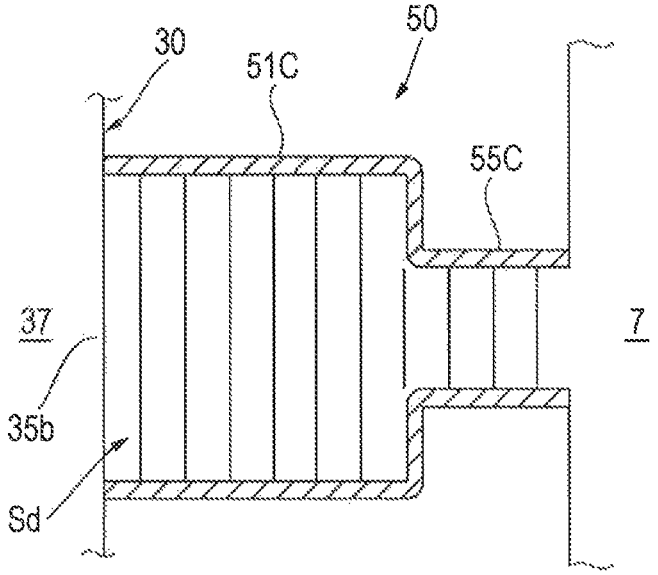
FIG. 8A is an explanatory diagram illustrating how low frequency components of intake sound are transmitted.

The sound vibration of the intake sound transmitted to the communication pipe 50 is transmitted to the downstream communication portion 55C via the reduced stepped portion 51C. At this time, as illustrated in FIG. 8A, some of low frequency components of sound Sd included in the sound vibration are reflected by the cabin-side end of the reduced stepped portion 51C, with the result that only a part of the sound vibration is transmitted to the downstream communication portion 55C. This is considered to be the reason why the magnitude of low frequency components of sound Sd may be reduced.

Figure 8B:
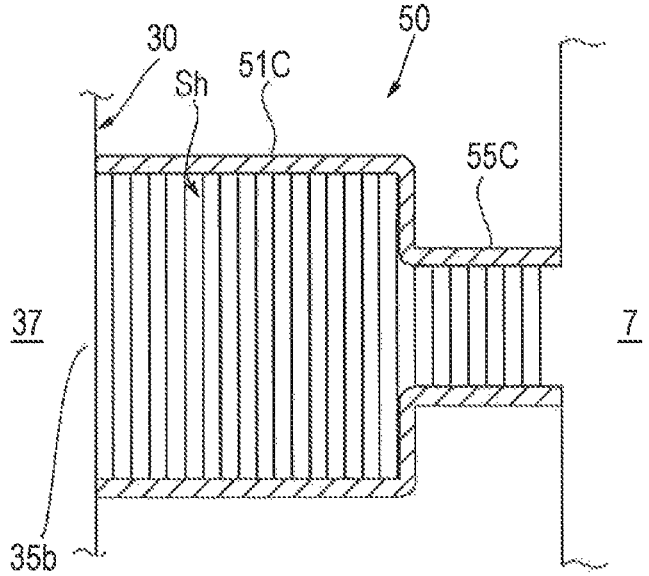
FIG. 8B is an explanatory diagram illustrating how high frequency components of intake sound are transmitted.

As illustrated in FIG. 8B, like the low frequency' components of sound Sd, some of high frequency components of sound Sh included in the sound vibration are reflected by the cabin-side end of the reduced stepped portion 51C, with the result that only a part of the sound vibration is transmitted to the downstream communication portion 55C. This is considered to be the reason why the magnitude of the high frequency components of sound Sh may be reduced.

Figure 7B:
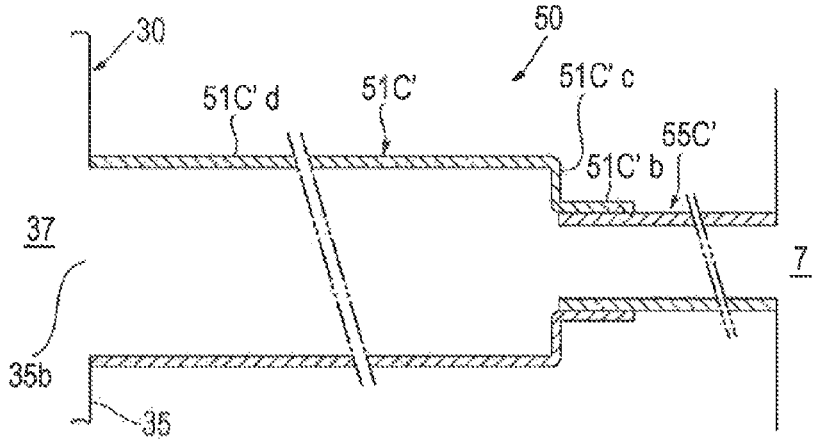
FIG. 7B is a cross-sectional view of a modification of the communication pipe.

In the third implementation mentioned above, the communication pipe 50 has the reduced stepped portion 51C and the downstream communication portion 55C that are formed integrally with each other (see FIG. 7A). However, as illustrated in FIG. 7B, a reduced stepped portion 51C' and a downstream communication portion 55C' may be made of a flexible material and may be formed as separate components, and the intake pipe-side end of the downstream communication portion 55C' may be connected with the cabin-side end of the reduced stepped portion 51C'. In this case, the downstream communication portion 55C' is formed in a tubular shape. The reduced stepped portion 51C' has a connecting portion 51C'b formed at the cabin-side end of the reduced stepped portion 51C', a side wall 51C'c formed at the intake pipe-side end of the connecting portion 51C'b, and a large pipe body 51D'd formed at the outer edge of the side wall 51C' c. The connecting portion 51C'b is a tubular portion with which the outer periphery of the intake pipe-side end of the downstream communication portion 55C' may fit. The side wall 51C'c is an annular portion that projects outward in the radial direction. The large pipe body 51C'd is a tubular portion that extends toward the intake pipe.

The connecting portion 51C'b is coupled to the downstream communication portion 55C' while in fitting engagement with the downstream communication portion 55C'. For example, by providing the inner surface of the connecting portion 51C'b with a locking protrusion, and providing the outer surface of the downstream communication portion 55C' with an engaging recess for locking engagement with the locking protrusion, the downstream communication portion 55C' may be coupled to the reduced stepped portion 51C' through locking engagement of the locking protrusion with the engaging recess. Alternatively, the downstream communication portion 55C' may be coupled to the reduced stepped portion 51C' by welding the connecting portion 51C'b to the downstream communication portion 55C'. In this way, by forming the communication pipe 50 by separate components, that is, the reduced stepped portion 51C' and the downstream communication portion 55C', and also forming the reduced stepped portion 51C' and the downstream communication portion 55C' by a flexible material, the freedom of placement of the communication pipe 50 within the engine compartment 3 may be improved.

Figure 9:
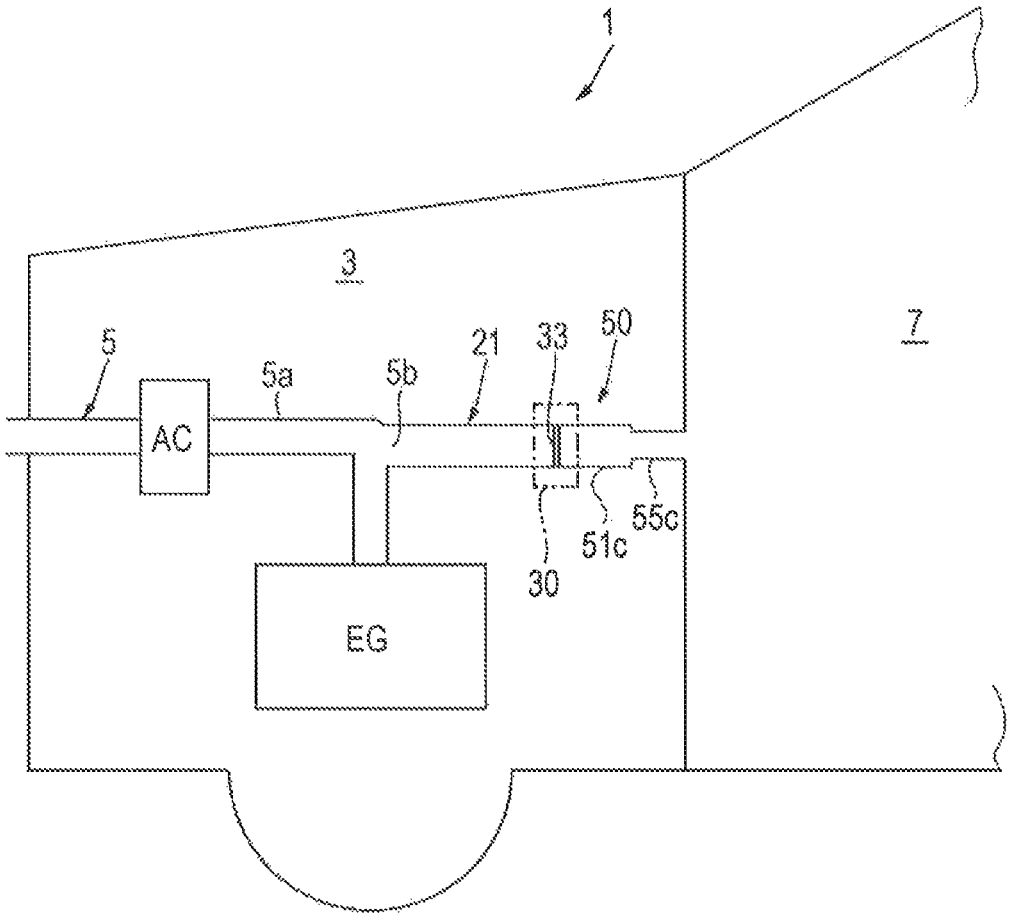
FIG. 9 is a schematic diagram of the lateral side of a modification of the intake sound introducing apparatus illustrated in FIG. 6.

In the third implementation mentioned above, the branch pipe 21 and the communication pipe 50 of the intake sound introducing apparatus 20 communicate with each other via the sound creator 30 (see FIG. 6). However, as illustrated in FIG. 9, it is also possible to provide the vibrator 33 inside the cabin-side end of the branch pipe 21 to form the sound creator 30, and connect the intake pipe-side end of the reduced stepped portion 51C of the communication pipe 50 with the cabin-side end of the branch pipe 21. This configuration simplifies the structure of the intake sound introducing apparatus 20, thereby reducing the cost of the intake sound introducing apparatus 20.

While the third implementation mentioned above is directed to the case in which the reduced stepped portion 51C is formed at the intake pipe side of the communication pipe 50, the same reduced stepped portion 51C may be formed at the intake pipe side of the branch pipe 21, and the reduced stepped portion 51C may communicate with the intake pipe 5.

While the cross-sectional shapes of the branch pipe 21 and communication pipe 50 are circular in the third implementation mentioned above, this should not be construed restrictively. The cross-sectional shapes of these components may be any one of triangular, rectangular, and polygonal shapes.

Fourth Implementation

Figure 10:
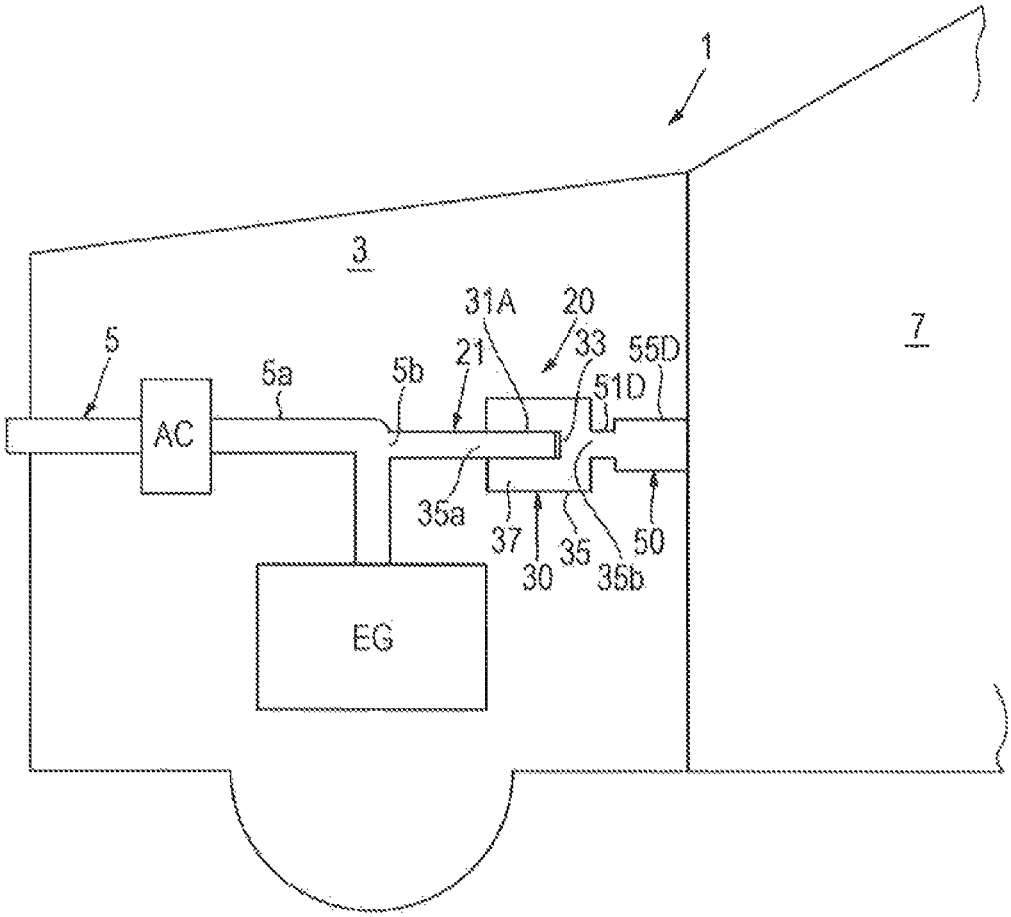
FIG. 10 is a schematic diagram of the lateral side of an intake sound introducing apparatus according to a fourth implementation of the present invention.

As illustrated in FIG. 10 (schematic diagram), an intake sound introducing apparatus 20 according to a fourth implementation is provided inside an engine compartment 3 of a vehicle 1. In the engine compartment 3, an intake pipe 5 for supplying combustion air to an engine EG is connected to the engine EG via an air cleaner AC. One end of the intake pipe 5 is open at and supported by a front end of the engine compartment 3. The other end of the intake pipe 5 is connected with the engine EG. The intake pipe 5 is formed in a cylindrical shape from synthetic resin or the like. The intake sound intro ducting apparatus 20 for introducing intake sound to the driver in a cabin 7 of the vehicle 1 is connected with a downstream side 5*a* of the intake pipe 5 located downstream of the air cleaner AC.

The intake sound introducing apparatus 20 has a branch pipe 21 that branches from the intake pipe 5, a sound creator 30 that communicates with the branch pipe 21, and a communication pipe 50 that provides communication between the sound creator 30 and the inside of the cabin 7. The branch pipe 21 is disposed in the engine compartment 3 in such a way that one end of the branch pipe 21 is connected with an opening 5*b* provided at the downstream side 5*a* of the intake pipe 5 located downstream of the air cleaner AC, and the other end of the branch pipe 21 extends toward the cabin 7. The branch pipe 21 is formed in a cylindrical shape from synthetic resin or the like.

The sound creator 30 has an inlet pipe 31A connected with the cabin-side end of the branch pipe 21, a vibrator 33 provided at the cabin-side end of the inlet pipe 31A, and a casing 35 that surrounds the inlet pipe 31A. The vibrator 33 is a sheet-like diaphragm made of either one of synthetic resin and rubber, which vibrates with the intake pulsation of the intake sound propagating within the branch pipe 21 and the inlet pipe 31A. The casing 35 is formed in a box shape. A front hole 35*a* is provided at one end side of the casing 35, and a rear hole 35*b* is provided at the other end side of the casing 35.

The intake pipe-side end of the inlet pipe 31A is open at and supported by the front hole 35*a*. The cabin-side end of the inlet pipe 31A is disposed opposite to the rear hole 35*b* with a predetermined distance inside. The front hole 35*a* is formed in substantially the same circular shape as the outer shape of the inlet pipe 31A, and the inlet pipe 31A is inserted in the front hole 35*a* so that there is no leakage of sound from the front hole 35*a*. A space 37 surrounded by the casing 35 is defined around the inlet pipe 31A. The space 37 has a size that allows multiple frequencies included in the sound vibration generated with vibration of the vibrator 33 as a sound source to resonate owing to air column vibration. The rear hole 35*b* has substantially the same size as the vibrator 33 and is formed in a cylindrical shape. The rear hole 35*b* transmits the intake pulsation produced from the vibrator 33 to the communication pipe 50.

Figure 11A:
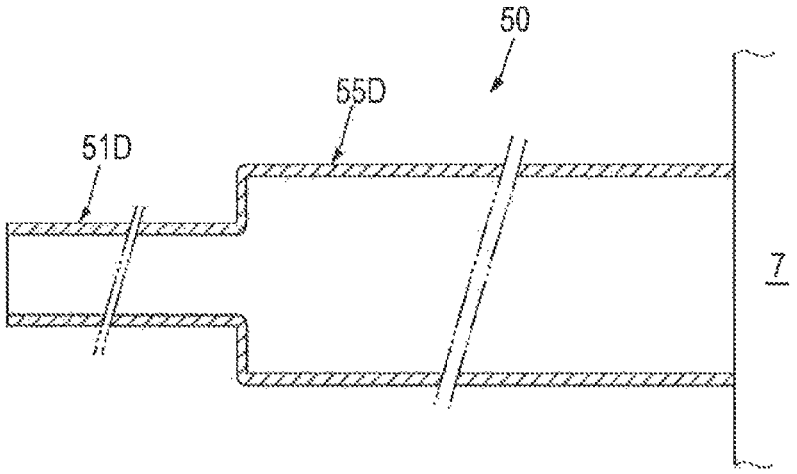
FIG. 11A is a cross-sectional view of a communication pipe according to the fourth implementation.

As illustrated in FIG. 10 and FIG. 11A (cross-sectional view), the communication pipe 50 has an upstream communication portion 51D having a tubular shape, and an enlarged stepped portion 55D having a tubular shape. The upstream communication portion 51D is connected with the rear hole 35*b* of the casing 35. The enlarged stepped portion 55D is connected with the cabin-side end of the upstream communication portion 51D, and juts outward with respect to the upstream communication portion 51D to define a stepped shape whose inside diameter changes in a non continuous fashion. The enlarged stepped portion 551) functions as a large diameter communication portion that extends toward the cabin. The upstream communication portion 51D communicates with the enlarged stepped portion 55D while having substantially the same inside diameter as the inside diameter of the rear hole 35*b*. The upstream communication portion 51D is formed of synthetic resin or the like.

The enlarged stepped portion 55D communicates with the cabin 7 while having an inside cross-sectional area larger than the inside cross-sectional area of the upstream communication portion 51D. The enlarged stepped portion 55D is disposed substantially coaxially with the upstream communication portion 51D. The intake pipe-side end of the enlarged stepped portion 55D is integrally connected with the cabin-side end of the upstream communication portion 51D.

In the intake sound introducing apparatus 20 configured in this way, as illustrated in FIG. 10, when outside air is taken in through the intake pipe 5 as the engine EG is driven, an intake pulsation at a frequency corresponding to the rotational speed of the engine EG is generated inside the intake pipe 5. The intake pulsation is transmitted to the vibrator 33 of the sound creator 30 through the branch pipe 21 from the intake pipe 5. Consequently, the vibrator 33 vibrates at a frequency corresponding to the rotational speed of the engine EG. Therefore, a sound vibration is created inside the sound creator 30, with the vibration of the vibrator 33 as a sound source. Then, multiple frequencies included in the sound vibration resonate owing to vibration of air column in the casing 35 and are transmitted to the communication pipe 50.

Then, unwanted high frequency components Sh of the intake sound transmitted to the communication pipe 50, for example, the valve noise of the engine EG and intake sound transmitted at high speed, are reduced in magnitude by the enlarged stepped portion 55D of the communication pipe 50. Consequently, unwanted high frequency components of sound Sh may be removed from the intake sound transmitted into the cabin 7, allowing a desired intake sound to be transmitted into the cabin 7.

The reasons why unwanted high frequency components of sound Sh may be removed by the enlarged stepped portion 55D are considered to be as follows.

Figure 12A:
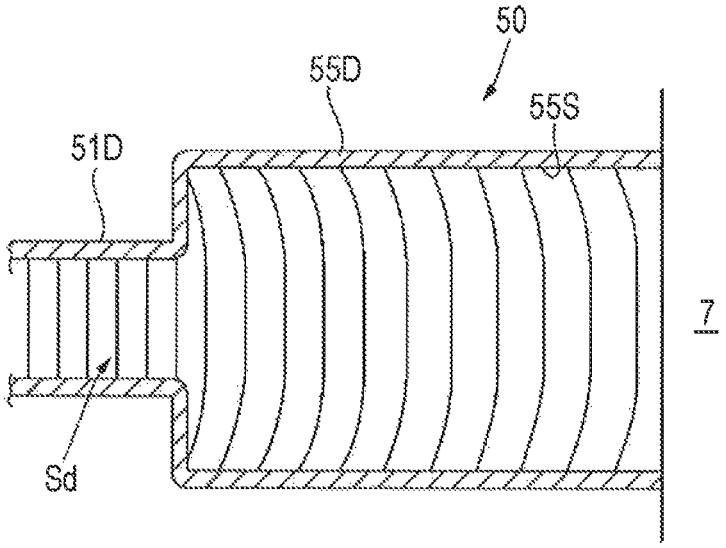
FIG. 12A is an explanatory diagram illustrating how low frequency components of intake sound are transmitted.

The sound vibration of the intake sound transmitted to the communication pipe 50 is transmitted to the enlarged stepped portion 55D via the upstream communication portion 51D. At this time, as illustrated in FIG. 12A, upon entry into the enlarged stepped portion 55D, low frequency components of sound Sd included in the sound vibration undergo small refraction and do not readily spread. Consequently, there is only a small decrease in the amount of energy caused by the sound vibration coming into contact with an inner surface 55S of the enlarged stepped portion 55D.

Figure 12B:
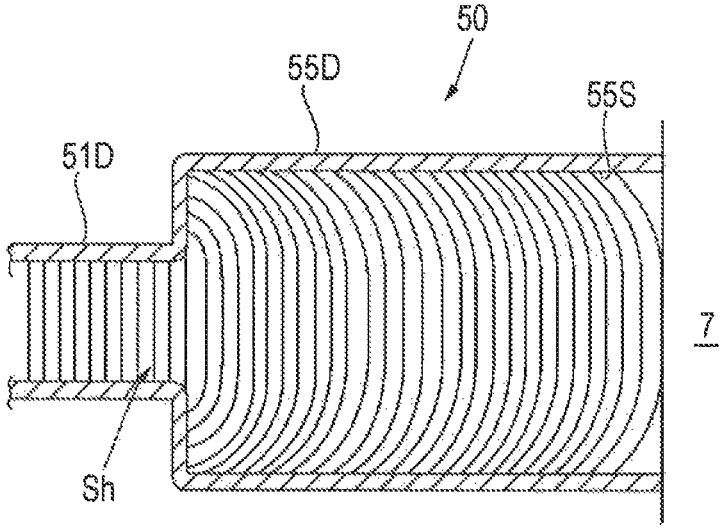
FIG. 12B is an explanatory diagram illustrating how high frequency components of intake sound are transmitted.

As illustrated in FIG. 12B, upon entry into the enlarged stepped portion 55D, high frequency components of sound Sh included in the sound vibration undergo refraction and spread widely. Consequently, there is a large decrease in the amount of energy caused by the sound vibration coming into contact with the inner surface 55S of the enlarged stepped portion 55D. This is considered to be why the magnitude of the sound may be reduced.

Figure 11B:
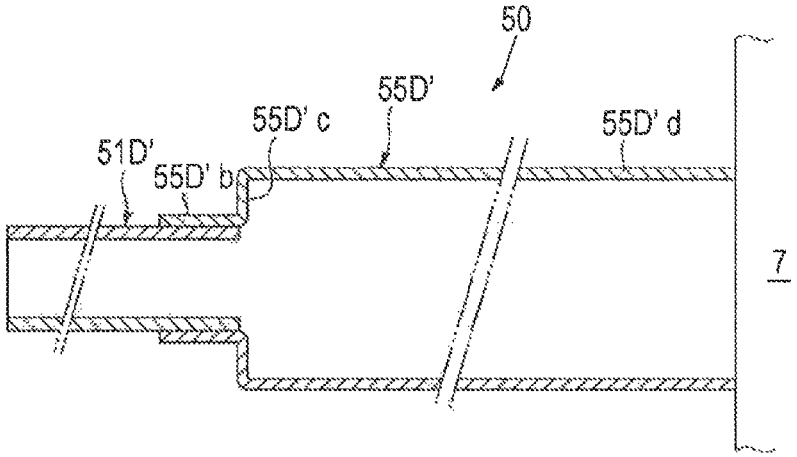
FIG. 11B is a cross-sectional view of a modification of the communication pipe.

In the fourth implementation mentioned above, the communication pipe 50 has the upstream communication portion 51D and the enlarged stepped portion 55D that are formed integrally with each other (see FIG. 11A). However, as illustrated in FIG. 11B, an upstream communication portion 51D' and an enlarged stepped portion 55D' may be made of a flexible material and may be formed as separate components, and the intake pipe-side end of the enlarged stepped portion 55D' may be connected with the cabin-side end of the upstream communication portion 51D'. In this case, the enlarged stepped portion 55D' is formed in a tubular shape. The enlarged stepped portion 55D' has a connecting portion 55D'b formed at the intake pipe-side end of the upstream communication portion 51D', a side wall 55D'c formed at the cabin-side end of the connecting portion 55D'b, and a large pipe body 55D'd formed at the outer edge of the side wall 55D'c. The connecting portion 55D'b is a tubular portion with which the outer periphery of the cabin-side end of the upstream communication portion 51D' may fit. The side wall 55D'c is an annular portion that projects outward in the radial direction. The large pipe body 55D'd is a tubular portion that extends toward the cabin 7.

The connecting portion 55D'b is coupled to the upstream communication portion 51D' while in fitting engagement with the upstream communication portion 51D'. For example, by providing the inner surface of the connecting portion 55D'b with a locking protrusion, and providing the outer surface of the upstream communication portion 51D' with an engaging recess for locking engagement with the locking protrusion, the downstream communication portion 55C' may be coupled to the upstream communication portion 51D' through locking engagement of the locking protrusion with the engaging recess. Alternatively, the downstream communication portion 55C' may be coupled to the upstream communication portion 51D' by welding the connecting portion 55D'b to the upstream communication portion 51D'. In this way, by forming the communication pipe 50 by separate components, that is, the upstream communication portion 51D' and the enlarged stepped portion 55D', and also forming the upstream communication portion 51D' and the enlarged stepped portion 55D' by a flexible material, the freedom of placement of the communication pipe 50 within the engine compartment 3 may be improved.

Figure 13:
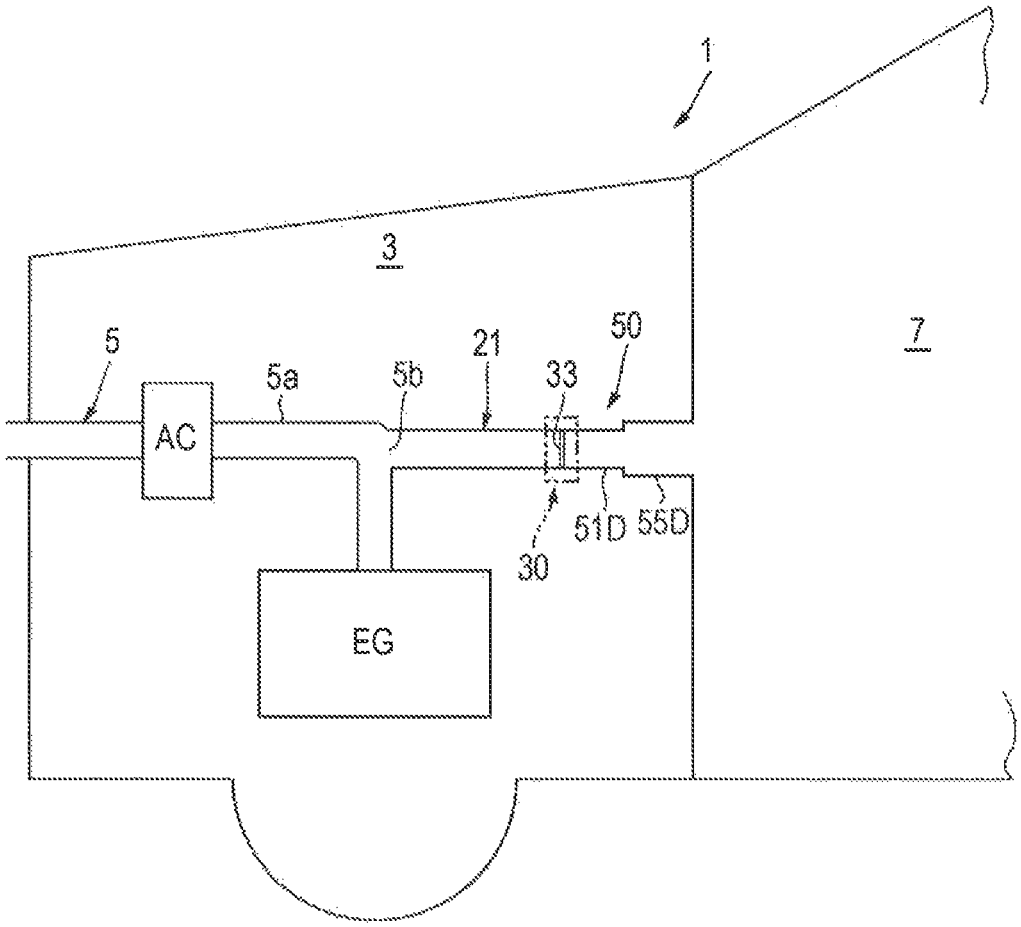
FIG. 13 is a schematic diagram of the lateral side of a modification of the intake sound introducing apparatus illustrated in FIG. 10.

In the fourth implementation mentioned above, the branch pipe 21 and the communication pipe 50 of the intake sound introducing apparatus 20 communicate with each other via the sound creator 30 (see FIG. 10). However, as illustrated in FIG. 13, it is also possible to provide the vibrator 33 inside the cabin-side end of the branch pipe 21 to form the sound creator 30, and connect the intake pipe-side end of the upstream communication portion 51D of the communication pipe 50 with the cabin-side end of the branch pipe 21. This configuration simplifies the structure of the intake sound introducing apparatus 20, thereby reducing the cost of the intake sound introducing apparatus 20.

While the fourth implementation mentioned above is directed to the case in which the enlarged stepped portion 55D is formed at the cabin side of the communication pipe 50, the enlarged stepped portion 55D may be formed at the cabin side of the branch pipe 21, and the enlarged stepped portion 55D may communicate with the inlet pipe 31A of the sound creator 30.

While the cross-sectional shapes of the branch pipe 21 and communication pipe 50 are circular in the fourth implementation mentioned above, this should not be construed restrictively. The cross-sectional shapes of these components may be any one of triangular, rectangular, and polygonal shapes.

The invention claimed is:

1. An intake sound introducing apparatus for introducing an intake sound of an engine mounted in a vehicle into a cabin, the intake sound introducing apparatus comprising:

a branch passage branching from an intake system of the engine;

a sound creator communicating with the branch passage, the sound creator having a vibrator vibrating with intake pulsation of the intake sound propagating within the branch passage, and a casing defining a space housing the vibrator; and a communication passage connecting to a hole provided in the casing and communicating fluidly with the space so as to transmit vibration of the vibrator into the cabin, wherein the communication passage has a stepped portion, and wherein the stepped portion is a reduced stepped portion, the reduced stepped portion jutting outward with respect to a downstream communication portion of the communication passage in which the reduced stepped portion is provided, the reduced stepped portion having an inside cross-sectional area larger than an inside cross-sectional area of the downstream communication portion and extending toward the intake system, the reduced stepped portion communicating with the sound creator.

2. The intake sound introducing apparatus according to claim 1, wherein:

the downstream communication portion is removably connected with an inner side of a cabin-side end of the reduced stepped portion, the downstream communication portion having a tubular shape with an outer shape smaller than an outer shape of the reduced stepped portion; and an intake system-side end of the downstream communication portion is inserted into the cabin-side end of the reduced stepped portion to connect the downstream communication portion and the reduced stopped portion together.

3. The intake sound introducing apparatus according to claim 1, wherein the space has a size that allows multiple frequencies generated by vibration of the vibrator to resonate owing to air column vibration.

4. The intake sound introducing apparatus according to claim 1, wherein an inlet pipe is provided at an end of the branch passage, and wherein the hole is provided at a location opposite to an end of the inlet pipe.

5. The intake sound introducing apparatus according to claim 2, wherein the downstream communication portion is made of a flexible material.

6. The intake sound introducing apparatus according to claim 2, wherein the reduced stepped portion is made of a flexible material.

* * * * *